US006244769B1

(12) United States Patent
Nakajima et al.

(10) Patent No.: US 6,244,769 B1
(45) **Date of Patent: *Jun. 12, 2001**

(54) STICK COSMETIC CONTAINER

(75) Inventors: Nobuyuki Nakajima, Takasaki; Mitsuru Endou, Tano-gun, both of (JP)

(73) Assignee: Mitsubishi Pencil Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/654,682

(22) Filed: May 29, 1996

(30) Foreign Application Priority Data

Jun. 21, 1995 (JP) ..... 7-154703

(51) Int. Cl.[7] ..... B43K 21/08
(52) U.S. Cl. ..... 401/75
(58) Field of Search ..... 401/55, 68, 75

(56) References Cited

U.S. PATENT DOCUMENTS

| | | | | |
|---|---|---|---|---|
| 3,215,264 | | 11/1965 | Silson et al. | 206/56 |
| 3,289,636 | * | 12/1966 | Tessier | 401/75 |
| 3,358,699 | * | 12/1967 | Bau | 401/75 |
| 3,639,068 | * | 2/1972 | Lockwood | 401/75 |
| 3,993,226 | | 11/1976 | Pavenick | 222/327 |
| 4,976,561 | * | 12/1990 | Kageyama | 401/75 |
| 4,993,857 | * | 2/1991 | Ohba | 401/75 |
| 4,997,299 | * | 3/1991 | Ohba | 401/75 |

FOREIGN PATENT DOCUMENTS

| | | | | |
|---|---|---|---|---|
| 387213 | * | 9/1990 | (EP) | 401/75 |
| 220435 | * | 8/1924 | (GB) | 401/75 |
| 79410 | * | 5/1989 | (JP) . | |

* cited by examiner

*Primary Examiner*—Jeanette Chapman
*Assistant Examiner*—M. Chambers
(74) *Attorney, Agent, or Firm*—Darby & Darby

(57) ABSTRACT

A cartridge includes a cartridge body and a holder for holding a stick cosmetic and movable forward/backward in accordance with a screw movement. A container body includes an outer cylinder for rotatably holding the cartridge body, a clicking rod movable forward/backward, a rotor rotated by a cam mechanism while moving forward together with the clicking rod when a clicking operation is performed, and a rotation rod for transmitting the rotational force of the rotor to the holder. The holder and the rotor engage with the rotation rod in the rotating direction and are slidable forward/backward. When a clicking operation is performed, the holder rotates to move forward in accordance with the screw movement. When a clicking operation is not performed, the cartridge body is rotated to move the holder forward/backward.

6 Claims, 14 Drawing Sheets

STICK COSMETIC CONTAINER

BACKGROUND OF THE INVENTION (1) Field of the Invention

The present invention relates to a stick cosmetic container.

(2) Description of the Prior Art

A conventionally known stick cosmetic container converts a forward movement of a clicking member obtained by clicking the tail end of the container into a rotary movement of a rotor by a cam mechanism (a clicking mechanism of this type will be referred to as a cam type clicking mechanism hereinafter) and draws out a stick cosmetic forward from the front end of the container in accordance with a screw movement.

For example, Japanese Patent Application Laid-open Sho 63 No. 31609 discloses a technique for extending or extracting a cosmetic stick held by a cosmetic tray by clicking a clicking member at the tail end of the container forward. However, since the cosmetic moves only forward upon clicking, if the cosmetic stick is excessively extended for use more than necessary, the length of the extended portion of the cosmetic stick cannot be adjusted to an appropriate length. Also, since the cosmetic stick stays exposed from the container body, a cap is necessary for protecting the exposed cosmetic stick when the cosmetic container is stored.

In Japanese Patent Publication Hei 2 No. 32883, Japanese Utility Model Application Laid-open Hei 1 No. 79410, Japanese Utility Model Application Laid-open Sho 63 No. 139813 and the like, a cosmetic stick can be extended and can be retracted (to be stored in the container) by a cam type clicking mechanism of the type described above.

In Japanese Patent Publication Hei 2 No. 32883 described above, the cosmetic stick is extended by a three-split collet chuck, and the entire mechanism of the collet chuck is moved forward and backward by the cam type clicking mechanism. When the cosmetic stick is not in use, the projecting portion of the pivotal cam cylinder of the cam type clicking mechanism is set on the retracting side of the groove of a stationary cam, thereby storing the cosmetic stick in the cosmetic stick cylinder. In Japanese Utility Model Application Laid-open Hei 1 No. 79410 described above, the cosmetic stick is extended in accordance with the screw movement, and the cosmetic stick is moved forward and backward (to be stored) by using the cam type clicking mechanism. In the extending container of Japanese Utility Model Application Laid-open Sho 63 No. 139813 described above, a rod-shaped cosmetic stick can be moved forward and extracted in accordance with a clicking operation by utilizing the cam type clicking mechanism.

However, in the conventional stick cosmetic container capable of moving a cosmetic stick forward and backward, although the cosmetic stick is moved forward for the same length as the clicking stroke every time clicking is performed, when clicking is stopped (when the clicking member is restored to the initial position by a spring), the cosmetic stick is undesirably moved backward simultaneously. Therefore, although a small forward-movement amount corresponding to one clicking operation set by the cam type clicking mechanism can be obtained, every time clicking is performed, the cosmetic stick repeats the forward/backward movement almost corresponding to one clicking stroke. In this case, when the distal end of the cosmetic stick stays in the container, no problem will arise. When, however, the cosmetic stick is located near the mouth which is close to a position where the cosmetic stick can be used, every time clicking is performed, the cosmetic stick repeats an unnatural movement of protruding and retracting from the mouth for almost one stroke. This motion seems unnatural to the user and is not very preferable for a cosmetic goods. Also, as the exposed length of the cosmetic stick is large, the cosmetic stick tends to break easily.

SUMMARY OF THE INVENTION

The present invention has been achieved in view of the above problems, and has as its object to provide a stick cosmetic container capable of smoothly obtaining a necessary extension length of a cosmetic stick by eliminating the unnatural, meaningless forward/backward movement of the cosmetic stick upon a clicking operation and capable of easily storing the cosmetic stick in a cartridge as required.

As the result of extensive studies, the present inventors combined a cam type clicking mechanism and a screw movement, allowed a driving force that acts forward upon a clicking operation to be transmitted to the cosmetic stick only as a rotational force, and enabled the cosmetic stick to be extended and retracted also with a screw movement through a rotating operation separate from the clicking operation, thereby solving the above problems.

More specifically, the first gist of the present invention resides in a stick cosmetic container comprising a cartridge for detachably holding a stick cosmetic and a container body on which the cartridge is mounted, characterized in that the cartridge mainly comprises a substantially cylindrical cartridge body and a holder for detachably holding the cosmetic stick at a front portion thereof to be disposed in the cartridge body and movable forward and backward in accordance with a screw movement when being rotated with respect to the cartridge body, the container body comprises; an outer cylinder, a clicking member, a clicking spring, a rotor, a driving spring, and a rotation rod, wherein the outer cylinder rotatably holding the cartridge body, the clicking member moving forward and backward in the outer cylinder upon being clicked, the clicking spring urging the clicking member backward, the rotor being restrained from rotating when a clicking operation is not performed, while the rotor being rotated when the clicking operation is performed through a predetermined angle by a cam mechanism converting a driving force of the clicking member into a rotational force while moving forward together with the clicking member, the driving spring urging the rotor backward, and the rotation rod being disposed in the outer cylinder to transmit a rotational force of the rotor to the holder and rotating the holder when the rotor is rotated; wherein at least the holder among the holder and the rotor is movable forward/backward with respect to the rotation rod, and the holder rotates, when the clicking operation is performed, through a predetermined angle upon reception of the rotational force from the rotor through the rotation rod to move forward in accordance with the screw movement, and becomes movable forward/backward when the clicking operation is not performed, upon rotation of the cartridge body with respect to the outer cylinder.

The second gist of the present invention resides in a stick cosmetic container according to the first gist of the invention, characterized in that the rotation rod has an outer flange constrained in a space defined between a front surface of an inner flange provided to an inner circumferential surface of the outer cylinder and a rear surface of a stopper incorporated in the outer cylinder.

The third gist of the present invention resides in a stick cosmetic container according to the first gist of the invention, characterized in that a portion of the rotation rod which corresponds to at least a movable range of the rotor has a polygonal section, and a through hole of the rotor also has a polygonal inner shape.

The fourth gist of the present invention resides in a stick cosmetic container according to the first gist of the invention, characterized in that a forward movement of the rotation rod is regulated by a tension spring provided between a clicking cap fitted in a rear end of the clicking member and the rotation rod.

The fifth gist of the present invention resides in a stick cosmetic container according to the first gist of the invention, characterized in that a holder lock is fitted in a rear end of the cartridge body.

The sixth gist of the present invention resides in a stick cosmetic container according to the fifth gist of the invention, characterized in that a guide cylinder of which a forward/backward movement is regulated by a front end face of the holder lock is fitted around the holder.

The seventh gist of the present invention resides in a stick cosmetic container according to the sixth gist of the invention, characterized in that the guide cylinder comprises a rotary holder that transmits a rotational force of the rotation rod, and a connecting portion having an inner shape corresponding to a shape of a distal end of the rotation rod is formed on a rear end portion of the rotary holder.

Finally, the eighth gist of the present invention resides in a stick cosmetic container according to the sixth gist of the invention, characterized in that the guide cylinder comprises a rotary holder that transmits a rotational force of the rotation rod, and a rear end of the rotary holder interlocks with a following member through an engaging structure having a substantially sawtooth-shaped mesh portion.

The stick cosmetic container according to the present invention has the above configuration. Thus, when the user performs a clicking operation, the clicking member moves forward. The rotor is rotated by the cam mechanism while moving forward together with the clicking member. As the rotational force of the rotor is transmitted to the holder through the rotation rod, the holder also rotates. At this time, since at least the holder is movable forward/backward with respect to the rotation rod, it accepts the rotational force of the rotation rod but does not accept the forward/backward driving force of the rotation rod. As the holder rotates with respect to the cartridge body, it moves forward in accordance with the screw movement, thereby moving forward the cosmetic stick held by the holder. When the clicking operation is stopped, the clicking member and the rotor are moved backward by the clicking spring and the driving spring, respectively, to return to where they had been before the clicking operation was performed.

When clicking is performed, the cosmetic stick moves forward for a forward amount corresponding to the rotating angle of the rotor. Thus, every time a clicking operation is performed, the cosmetic stick always performs only the forward movement. This eliminates the unnatural, meaningless forward/backward movement of the conventional cosmetic stick that takes place every time clicking is performed, so that a necessary extension length of the cosmetic stick can be obtained smoothly.

When clicking is not performed, the cartridge body moves forward/backward upon being rotated with respect to the outer cylinder. More specifically, when clicking is not performed, the rotary movement of the rotor is constrained and the holder and the rotor engage with the rotation rod in the rotating direction. Thus, when the cartridge body is rotated in a predetermined direction with respect to the outer cylinder, the holder and the cosmetic stick move either forward or backward in accordance with the screw movement. As a result, after it is used, the cosmetic stick that has been exposed by clicking can be easily retracted and stored by rotating the cartridge body.

DESCRIPTION OF THE PREFERRED EMBODIMENTS

The preferred embodiments of the present invention will be described with reference to the accompanying drawings.

Figure 1:
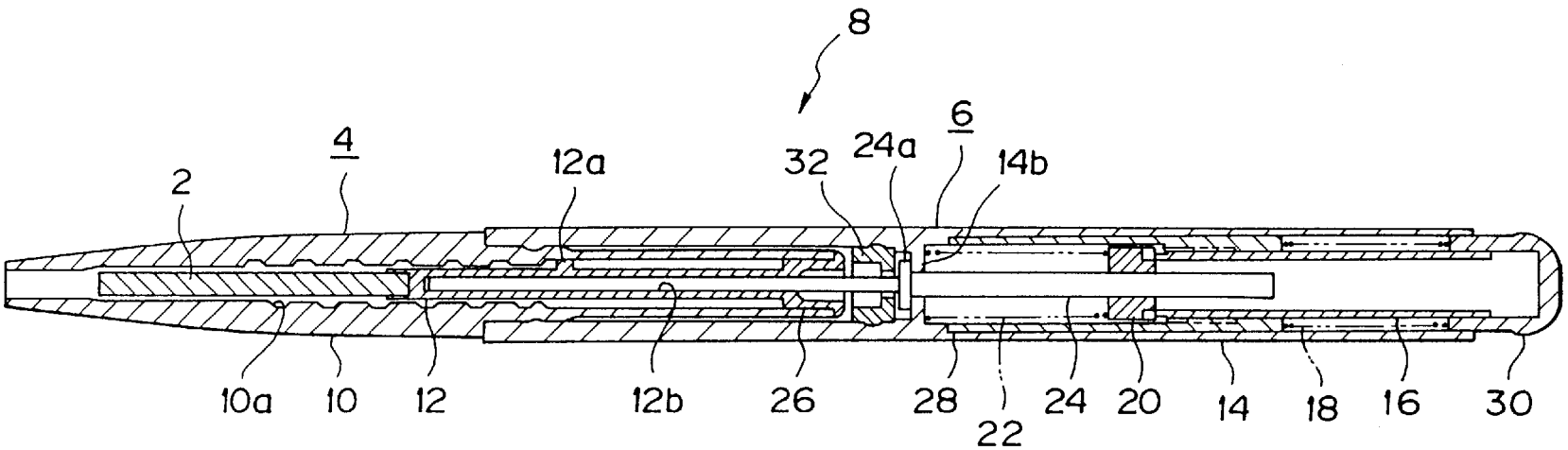
FIG. 1 is a longitudinal sectional view of a stick cosmetic container according to the first embodiment of the present invention.
Figure 2:
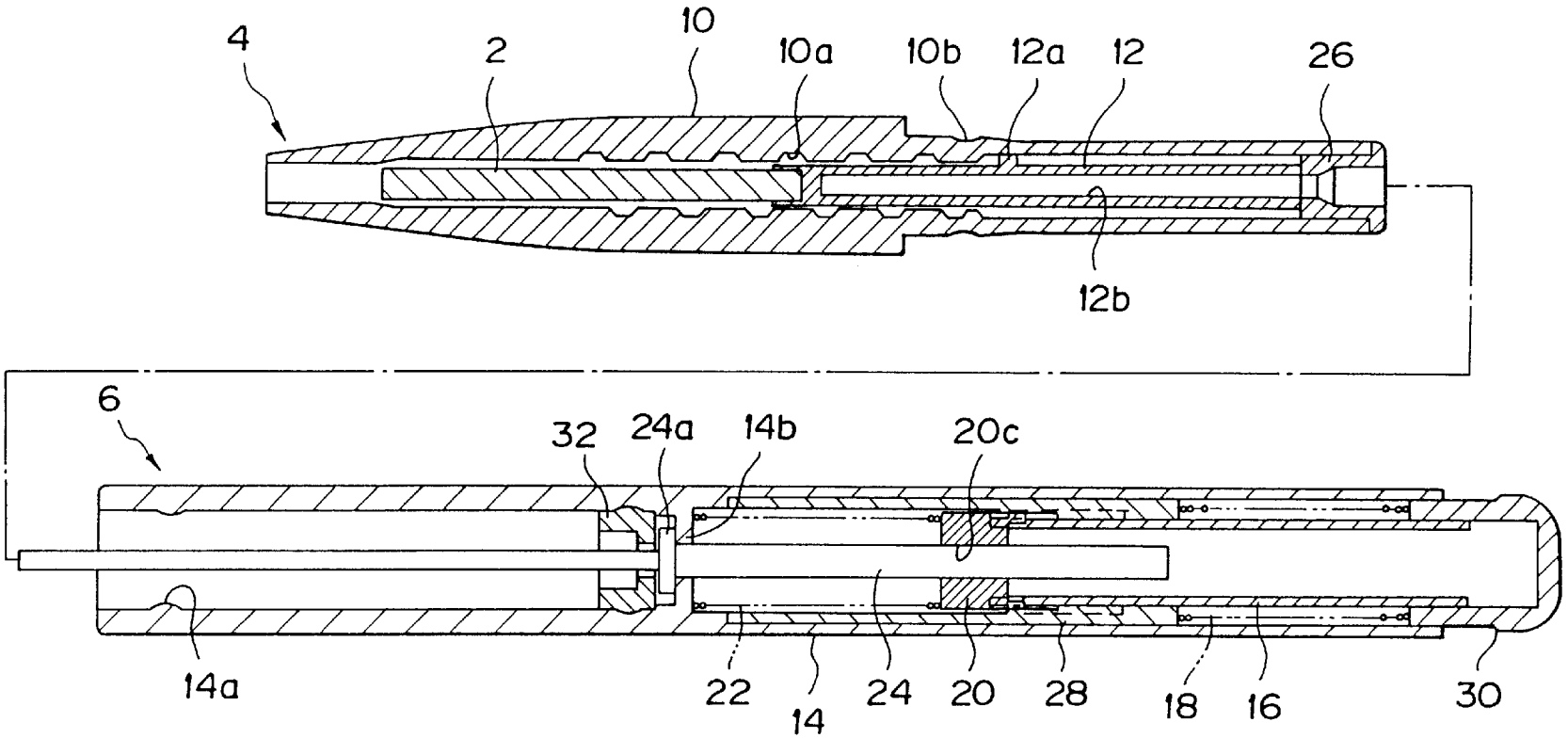
FIG. 2 is an exploded longitudinal sectional view of a cartridge and a container body according to the first embodiment.

The first embodiment will be described. As shown in FIGS. 1 and 2, a stick cosmetic container 8 of the first embodiment has a cartridge 4 for detachably holding a stick cosmetic 2, and a container body 6 on which the cartridge 4 is mounted. The cosmetic stick 2 is a lipstick, an eyeshadow, an eyeliner, an eyebrow pencil, or the like.

The cartridge 4 is mainly constituted by a substantially cylindrical cartridge body 10, a holder 12, and a holder lock 26, as shown in FIG. 2. The holder 12 detachably holds the cosmetic stick 2 at its front portion and is disposed in the cartridge body 10. When the holder 12 rotates with respect to the cartridge body 10, it can move either forward or backward in accordance with a screw movement. The holder lock 26 is fitted in the rear end of the cartridge body 10.

A spiral groove 10*a* is formed in the inner wall of the cartridge body 10 about the central axis of the cartridge. A screw projection 12*a* adapted to threadably engage with the spiral groove 10*a* is provided at substantially the central portion in the forward-to-backward direction of the holder 12. When the holder 12 rotates relative to the cartridge body 10, the screw projection 12*a* moves in the spiral groove 10*a,* so that the holder 12 and the cosmetic stick 2 move in the cartridge body 10 either forward or backward. A hollow portion 12*b* having a polygonal cross section is formed in the rear portion of the holder 12.

The container body 6 has an outer cylinder 14, an inner cylinder 28, a clicking rod (corresponding to a clicking member) 16, a clicking cap 30, a clicking spring 18, a rotor 20, a driving spring 22, and a rotation rod 24, as shown in FIG. 2. The outer cylinder 14 rotatably holds the cartridge body 10. The inner cylinder 28 is fitted in the outer cylinder 14. The clicking rod 16 moves forward/backward in the outer cylinder 14 upon a clicking operation. The clicking cap 30 is fitted in the rear end of the clicking rod 16 and is clicked by the user. The clicking spring 18 urges the clicking cap 30 and the clicking rod 16 backward. When a clicking operation is not performed, the rotation of the rotor 20 is constrained. When a clicking operation is performed, the rotor 20 is rotated through a predetermined angle by a cam mechanism that converts the driving force of the clicking rod 16 into a rotational force, while it moves forward together with the clicking rod 16. The driving spring 22 urges the rotor 20 backward. The rotation rod 24 is disposed in the outer cylinder 14 such that its movement in the forward/backward direction is constrained. The rotation rod 24 transmits the rotational force of the rotor 20 to the holder 12.

As shown in FIG. 2, the outer cylinder 14 has a projection 14*a* formed on the inner circumferential surface of the mouth of its front end in the circumferential direction. This projection 14*a* is fitted in an annular groove 10*b* in the outer circumferential surface at the rear end portion of the cartridge body 10. The inner circumferential surface of the mouth of the outer cylinder 14 loosely fits on the outer circumferential surface of the cartridge body 10. Hence, although the cartridge body 10 cannot move forward/backward with respect to the outer cylinder 14 due to the presence of the projection 14*a,* it is rotatable in the circumferential direction.

Figure 3A:
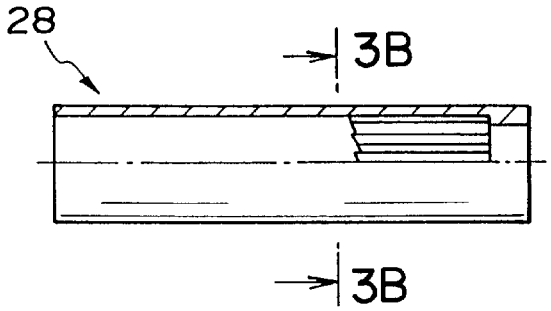
FIG. 3A is a longitudinal sectional view of one side of an inner cylinder according to the first embodiment.
Figure 3B:
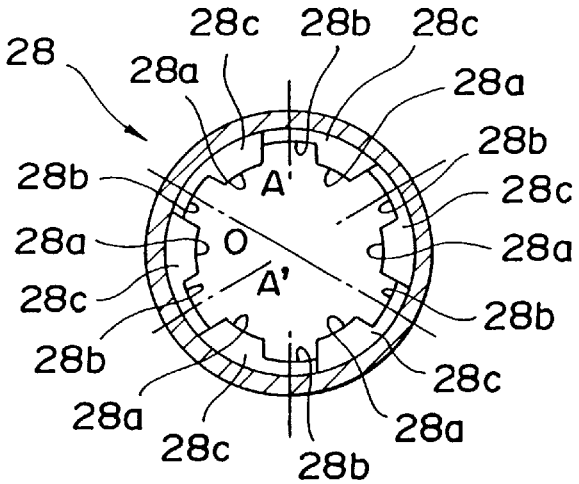
FIG. 3B is a sectional view taken along the line B—B of FIG. 3A.
Figure 3C:
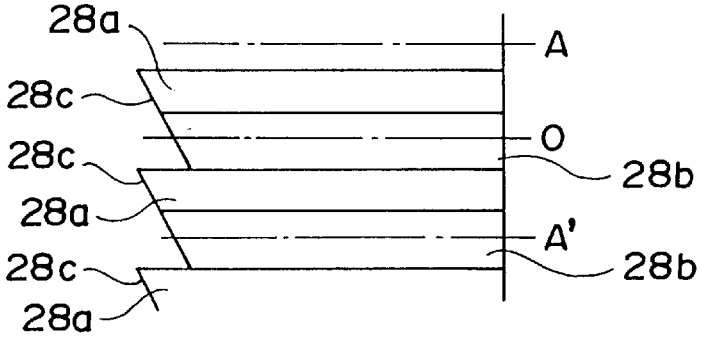
FIG. 3C is a developed view taken along the line A–O–A' of FIG. 3B.

As shown in FIGS. 3A, 3B, and 3C, cam portions 28*a* extending in the forward-to-backward direction are formed at, e.g., six positions in the circumferential direction, of the rear portion of the inner circumferential surface of the inner cylinder 28. Grooves 28*b* are formed among the adjacent cam portions 28*a*. Inclined surface cams 28*c* are formed on the front end surfaces of the adjacent grooves 28*b* and cam portions 28*a*.

Of FIGS. 3A to 3C, FIG. 3A is a longitudinal sectional view of one side of the inner cylinder 28 of the first embodiment, FIG. 3B is a sectional view taken along the line B—B of FIG. 3A, and FIG. 3C is a developed view taken along the line A–O–A' of FIG. 3B.

Figure 4A:
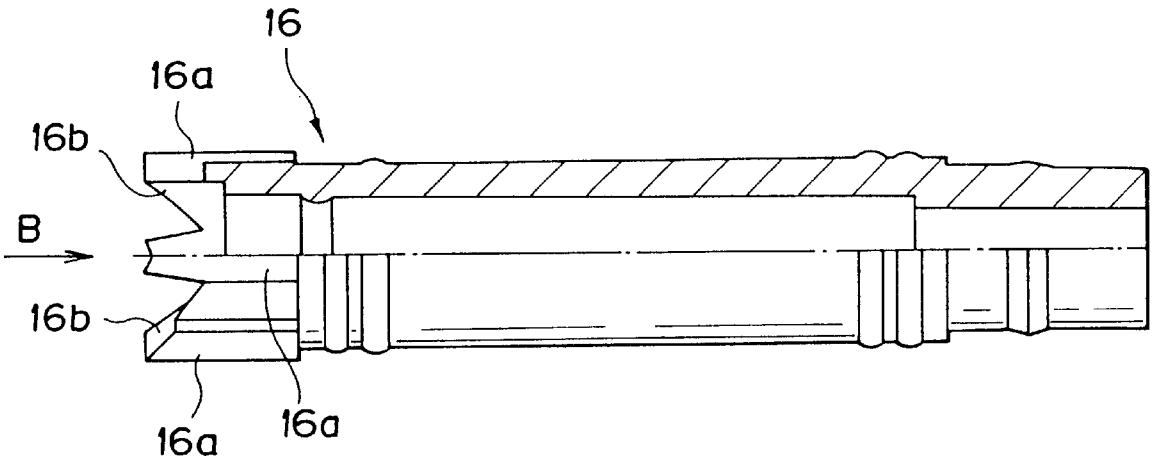
FIG. 4A is a longitudinal sectional view of one side of a clicking rod according to the first embodiment.
Figure 4C:
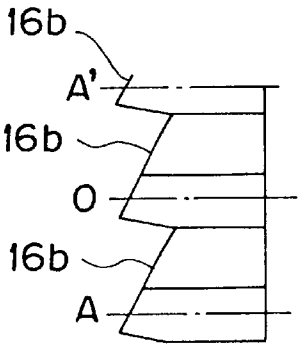
FIG. 4C is a developed view taken along the line A–O–A' of FIG. 4B.
Figure 4B:
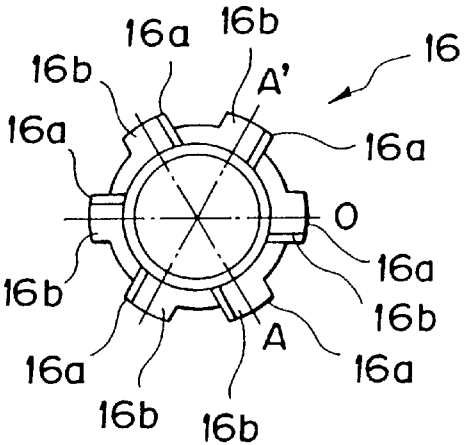
FIG. 4B is a view seen from the direction of an arrow B of FIG. 4A.

As shown in FIGS. 4A, 4B, and 4C, projections 16*a* adapted to fit in the grooves 28*b* are formed at, e.g., six positions in the circumferential direction, of the outer circumferential surface at the front end portion of the clicking rod 16. These projections 16*a* are located in the grooves 28*b* both when the clicking operation is and is not performed. An inclined surface cam 16*b* inclined in the same direction as that of the inclined surface cam 28*c* is formed on the front end face of each projection 16*a*.

Of FIGS. 4A to 4C, FIG. 4A is a longitudinal sectional view of one side of the clicking rod 16 of the first embodiment, FIG. 4B is a view seen from the direction of an arrow B of FIG. 4A, and FIG. 4C is a developed view taken along the line A–O–A' of FIG. 4B.

Figure 5A:
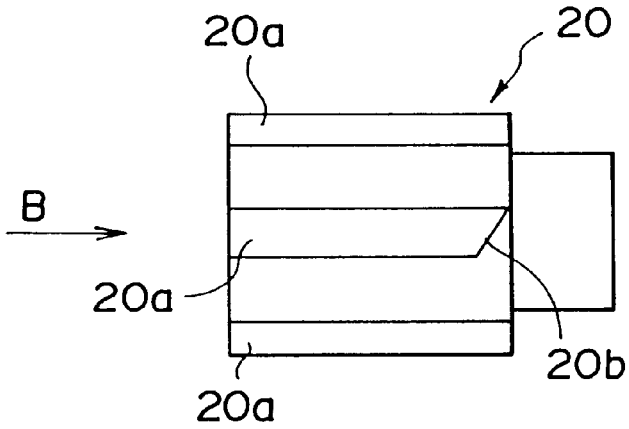
FIG. 5A is a side view of a rotor according to the first embodiment.
Figure 5B:
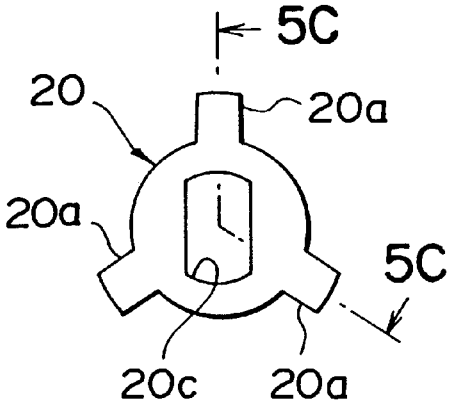
FIG. 5B is a view seen from the direction of an arrow B of FIG. 5A.
Figure 5C:
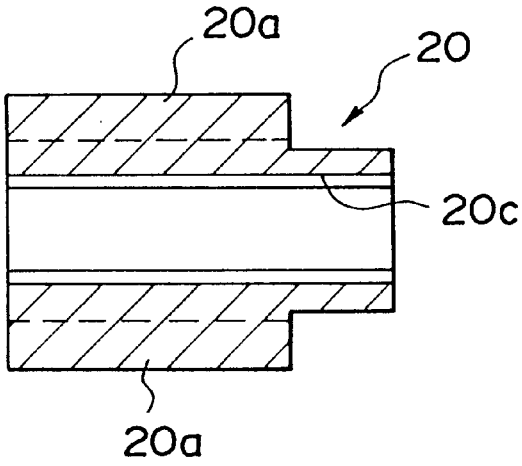
FIG. 5C is a sectional view taken along the line C—C of FIG. 5B.

As shown in FIGS. 5A, 5B, and 5C, the rotor 20 has a substantially cylindrical shape. Ribs 20*a* extending in the forward-to-backward direction are formed at, e.g., three positions in the circumferential direction, of the outer circumferential surface of the rotor 20. An inclined surface cam 20*b* is formed on the rear end of each rib 20*a*. The inclined surface cams 20*b* have shapes corresponding to the inclined surface cams 28*c* and the inclined surface cams 16*b,* and abut against the inclined surface cams 28*c* when a clicking operation is not performed.

Of FIGS. 5A to 5C, FIG. 5A is a side view of the rotor 20 of the first embodiment, FIG. 5B is a view seen from the direction of an arrow B of FIG. 5A, and FIG. 5C is a sectional view taken along the line C—C of FIG. 5B.

The rotation rod 24 has an outer flange 24*a* at its substantially central portion in the forward-to-backward direction, as shown in FIG. 2. The outer flange 24*a* is arranged in a space between the front surface of an inner flange 14*b* protrudedly provided on the inner circumferential surface of the outer cylinder 14 and the rear surface of a stopper 32 incorporated in the outer cylinder 14. Thus, the forward/backward movement of the outer flange 24*a* is constrained. The rotation rod 24 supports the rotor 20 at its rear portion to be slidable in the forward/backward direction, and engages with the rotor 20 in the rotating direction. For example, a portion of the rotation rod 24 corresponding to at least the movable range of the rotor 20 is formed of a polygonal section, and a through hole 20*c* of the rotor 20 is also formed of a polygonal inner shape. Hence, although the rotor 20 is movable in the forward/backward direction with respect to the rotation rod 24, it is restrained from rotating by the rotation rod 24. The front portion of the rotation rod 24 is formed of a polygonal section corresponding to the shape of the hollow portion 12*b* of the holder 12, supports the holder 12 to be slidable in the forward/backward direction, and engages with the holder 12 in the rotating direction, in the same manner as the relationship with respect to the rotor 20.

When a clicking operation is performed, the holder 12 rotates through a predetermined angle, upon reception of a rotational force from the rotor 20 through the rotation rod 24, to move forward in accordance with the screw movement. When a clicking operation is not performed, the cartridge body 10 is rotated with respect to the outer cylinder 14 to move the holder 12 forward/backward.

Figure 6A:
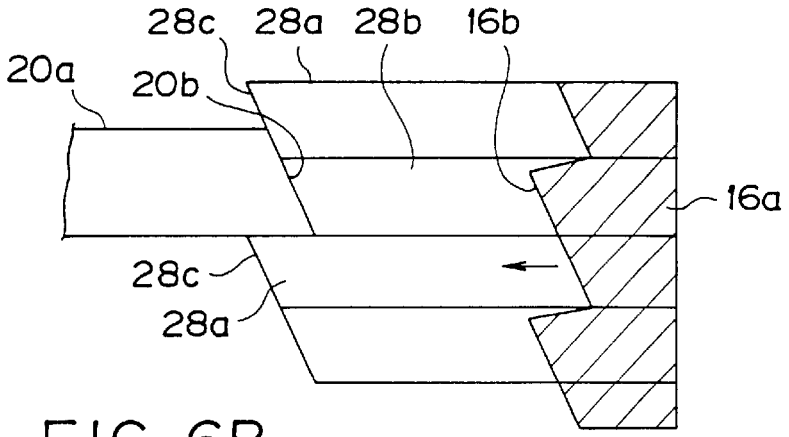
FIG. 6A is a diagram for explaining the operation of a cam mechanism at the start of clicking according to the first embodiment.

The operation of the first embodiment will be described in detail. The extending operation of the cosmetic stick 2 by clicking will be described first. When the user holds the stick cosmetic container 8 and clicks the clicking cap 30 at its tail end forward, the clicking rod 16 also moves forward. As shown in FIG. 6A, the clicking rod 16 moves forward as its projections 16*a* are guided in the grooves 28*b* of the inner cylinder 28. Simultaneously, the clicking rod 16 pushes the inclined surface cams 20*b* of the rotor 20 with its inclined surface cams 16*b*. At this time, the rotor 20 receives a rotational force from the inclined surface cams 16*b*. However, as the rear end portions of the ribs 20*a* are constrained by the side surfaces of the cam portions 28*a* and the inclined surface cams 28*c*, the rotor 20 does not rotate but slidably moves forward on the rotation rod 24.

Figure 6B:
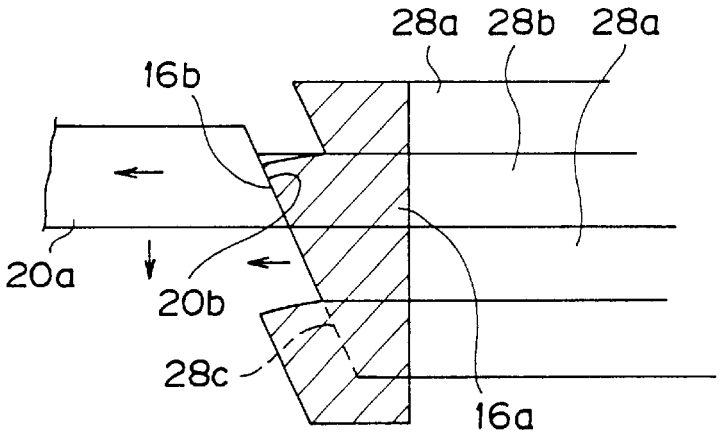
FIG. 6B is a diagram showing a state of the cam mechanism of FIG. 6A upon a full-stroke clicking operation.
Figure 6C:
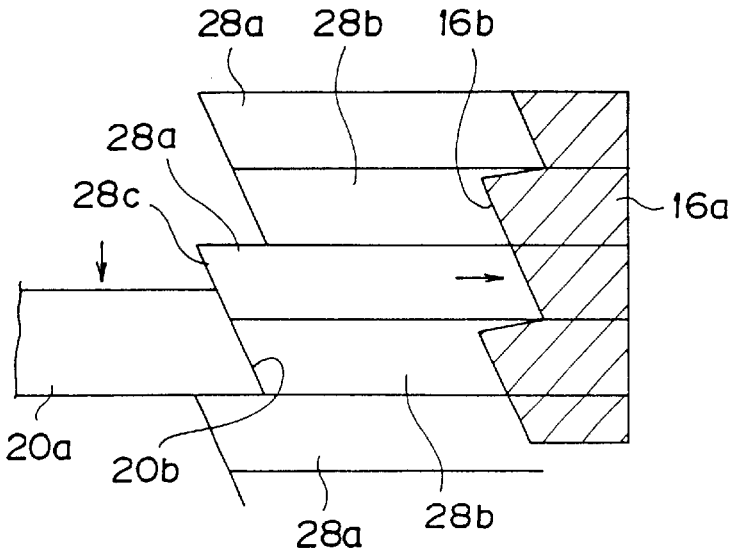
FIG. 6C is a diagram showing a state of the cam mechanism of FIG. 6A when clicking is stopped.

When the inclined surface cams 20*b* of the rotor 20 coincide with the inclined surface cams 28*c* of the cam portions 28*a*, the rotor 20 becomes rotatable as its ribs 20*a* are released from the side surfaces of the cam portions 28*a*, as shown in FIG. 6B, and rotates for an amount corresponding to one step of the inclined surface cams 16*b* upon reception of a surface pressure from the inclined surface cams 16*b* of the clicking rod 16. When the user releases the clicking cap 30, the clicking rod 16 and the rotor 20 are moved backward by the clicking spring 18 and the driving spring 22, respectively, to be restored to where they had been before a clicking operation was performed. At this time, as shown in FIG. 6C, the rotor 20 slides backward on the rotation rod 24 while further rotating until the side surfaces of its ribs 20*a* abut against the side surfaces of the next cam portions 28*a*, and waits for a next clicking operation.

Figure 7:
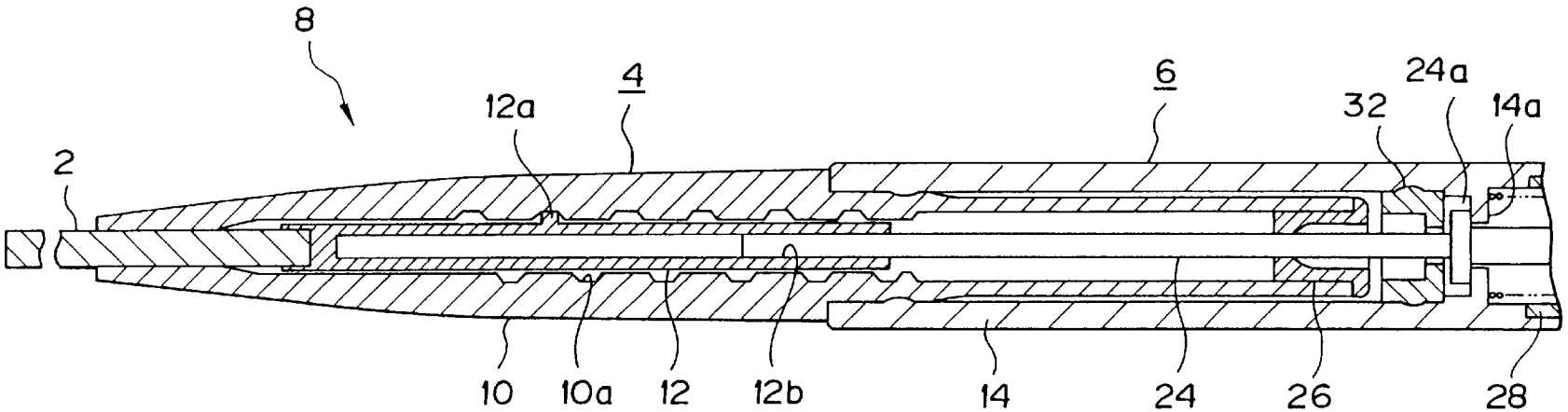
FIG. 7 is a longitudinal sectional view of the front portion of the container from which the cosmetic stick is extended to be exposed in the first embodiment.

In this manner, the rotor 20 rotates through a predetermined angle upon one clicking operation due to the cam type clicking mechanism. The rotational force of the rotor 20 is transmitted to the holder 12 through the rotation rod 24. Thus, when the holder 12 rotates, the screw projection 12*a* on the holder 12 moves in the spiral groove 10*a*, so that the holder 12 and the cosmetic stick 2 move forward for a predetermined amount while they slide on the rotation rod 24 in accordance with a screw movement. FIG. 7 shows a state wherein the cosmetic stick 2 is moved forward by several clicking operations to project from the opening at the front end of the cartridge body 10.

An operation required for extending and retracting the cosmetic stick 2 without performing a clicking operation will be described. When the clicking operation is not performed, rotary movement of the rotor 20 is constrained and the holder 12 and the rotor 20 engage with the rotation rod 24 in the rotating direction. Thus, when the cartridge body 10 is rotated in a predetermined direction with respect to the outer cylinder 14, the holder 12 and the cosmetic stick 2 can be moved either forward or backward in accordance with the screw movement.

According to the first embodiment that effects in this manner, in a clicking operation, every time the clicking operation is performed, the cosmetic stick 2 always performs only the forward movement. The unnatural, meaningless forward/backward movement of the conventional cosmetic stick that takes place every time the clicking operation is performed is thus eliminated, so that a necessary extension length of the cosmetic stick can be obtained smoothly. After use, the cosmetic stick 2 (see FIG. 7) that has been exposed by the clicking operation can be easily retracted in the cartridge body 10 by rotating the cartridge body 10.

Figure 8:
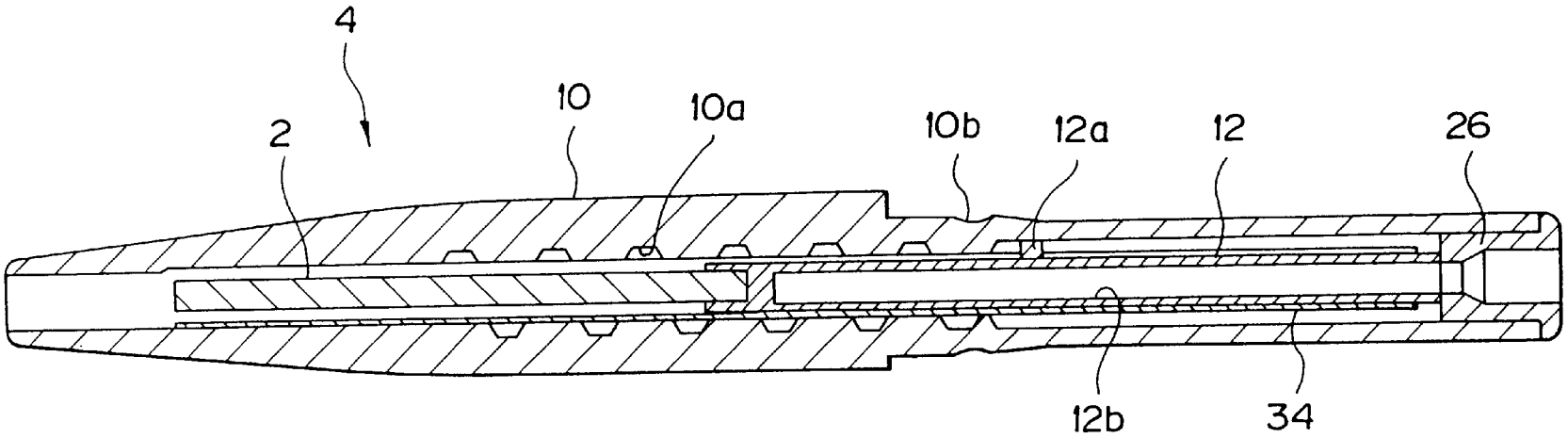
FIG. 8 is a longitudinal sectional view of a cartridge according to a modification of the first embodiment.
Figure 9:
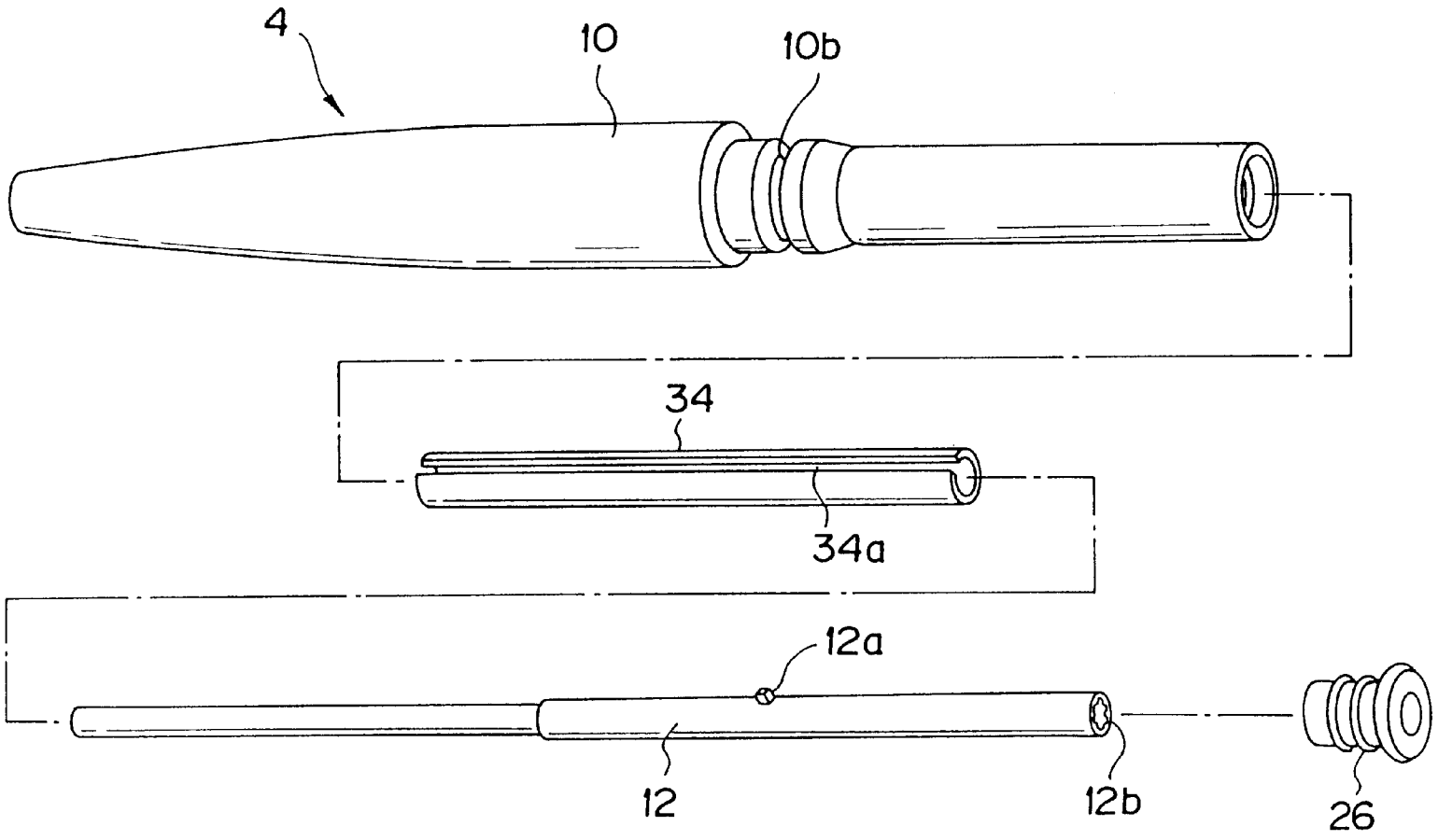
FIG. 9 is an exploded perspective view of the cartridge according to the modification of the first embodiment.

As shown in FIGS. 8 and 9, in the cartridge 4, a guide cylinder 34 whose forward/backward movement is regulated by the front end face of the holder lock 26 may be fitted around the holder 12. A slit 34*a* is formed in the guide cylinder 34 in its longitudinal direction, and the screw projection 12*a* of the holder 12 is fitted in the spiral groove 10*a* as it is exposed from the slit 34*a*. Therefore, this guide cylinder 34 protects the cosmetic stick 2 from the spiral groove 10*a* during a screw movement or while storing the cosmetic stick 2, and smoothly guides the forward/backward movement of the holder 12 during a screw movement.

Figure 10:
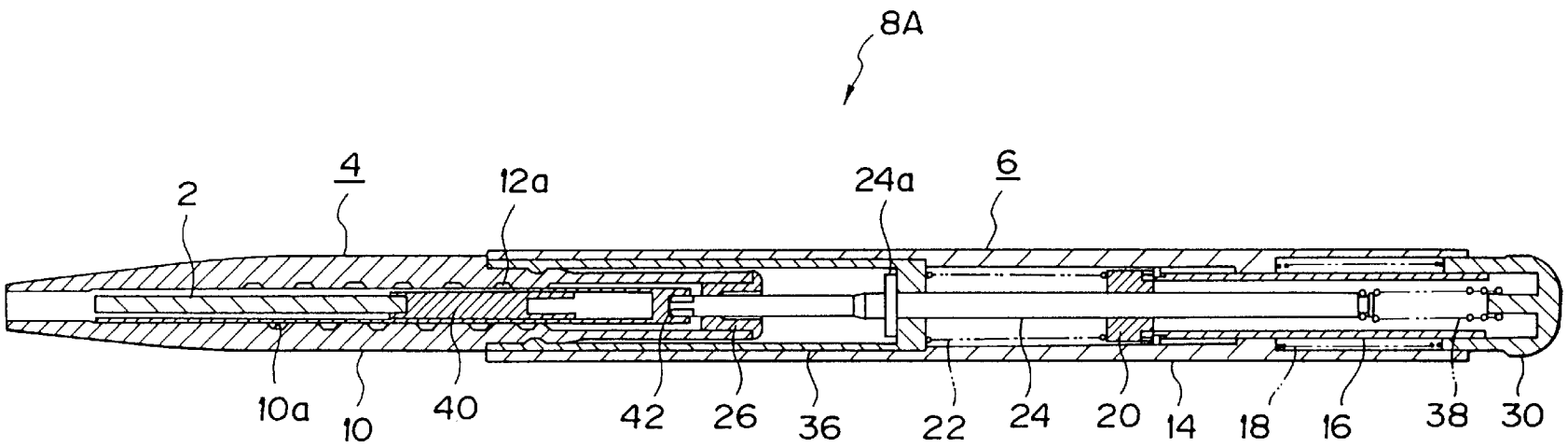
FIG. 10 is a longitudinal sectional view of a stick cosmetic container according to the second embodiment of the present invention.
Figure 11:
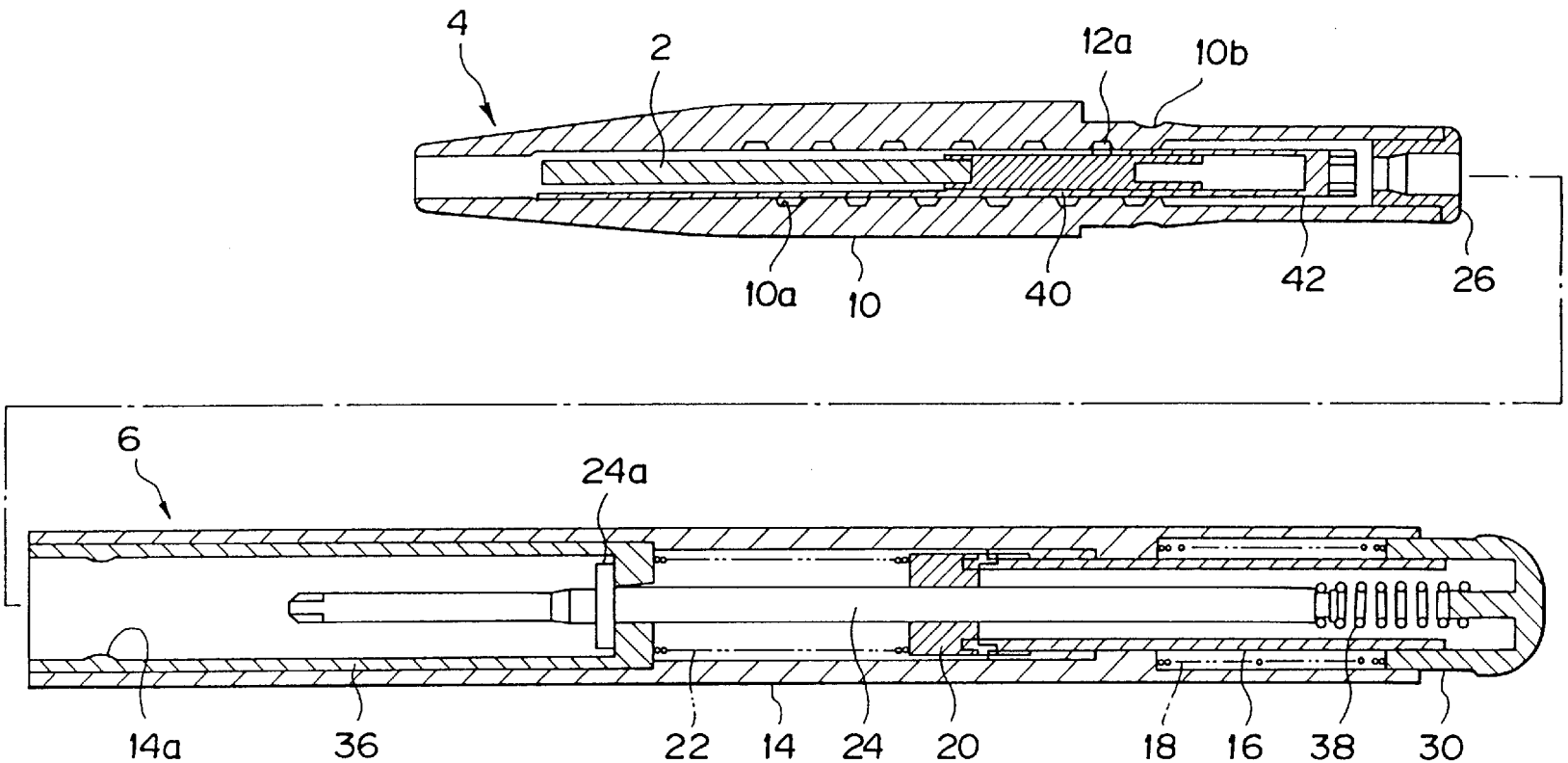
FIG. 11 is an exploded longitudinal sectional view of a cartridge and a container body according to the second embodiment.

The second embodiment will be described. As shown in FIGS. 10 and 11, a stick cosmetic container 8A of the second embodiment is obtained by removing the inner cylinder 28 and the stopper 32 from the basic arrangement of the first embodiment and forming cam portions 28*a*, grooves 28*b*, and inclined surface cams 28*c* on the inner circumferential surface of the outer cylinder 14. In addition to these changes, another inner cylinder 36 is fitted in the front side portion of the outer cylinder 14, and the rear portion of a cartridge body 10 is mounted in the inner cylinder 36. The front end of a driving spring 22 is supported by the rear end face of the inner cylinder 36. The backward movement of a rotation rod 24 is regulated by the front surface of the bottom wall of the inner cylinder 36, and the forward movement of the rotation rod 24 is regulated by a tension spring 38 provided between a clicking cap 30 and the rotation rod 24. The cam type clicking mechanism of the second embodiment functions substantially in the same manner as that of the first embodiment, and its description will thus be omitted.

In place of the holder 12 of the first embodiment, a holder 40 for holding a cosmetic stick 2 and a rotary holder 42 to be fitted around the holder 40 are disposed in the cartridge body 10. A connecting portion having an inner shape corresponding to the shape (e.g., a crisscross section) of the distal end of the rotation rod 24 is formed on the rear end portion of the rotary holder 42. A slit similar to the that of the guide cylinder 34 is formed in the rotary holder 42 in the forward-to-backward direction. More specifically, this rotary holder 42 has the function of the guide cylinder 34 and also serves to transmit the rotational force of the rotation rod 24 to the holder 40. In the first embodiment, when the cartridge 4 is not mounted, the rotation rod 24 projects out from the mouth of the outer cylinder 14. In contrast to this, in the second embodiment, the distal end of the rotation rod 24 is entirely stored in the outer cylinder 14, as shown in FIG. 11. Therefore, even if the user erroneously drops a container body 6, damage to the rotation rod 24 can be prevented.

Figure 12:
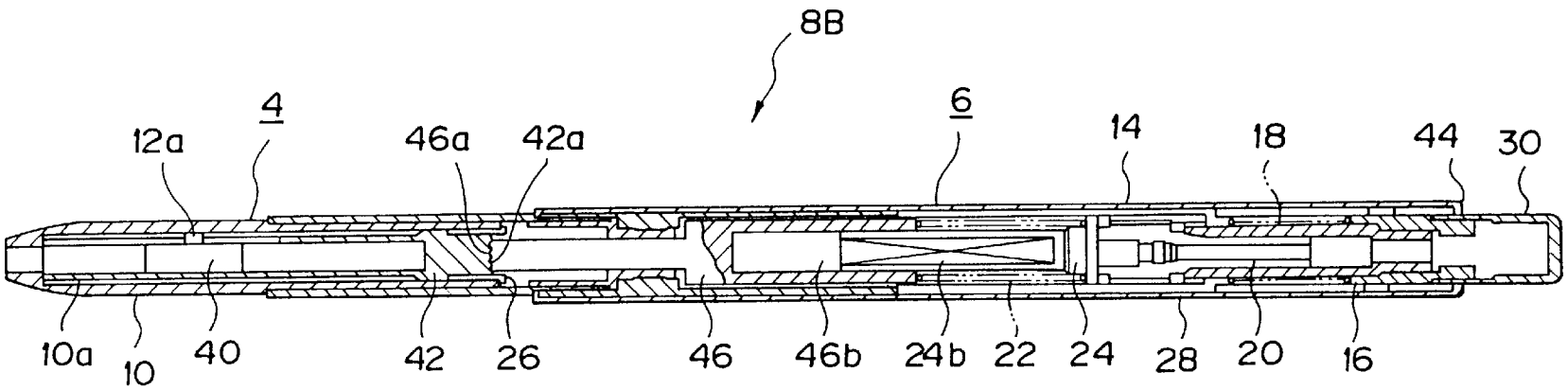
FIG. 12 is a longitudinal sectional view of a stick cosmetic container according to the third embodiment of the present invention.
Figure 13:
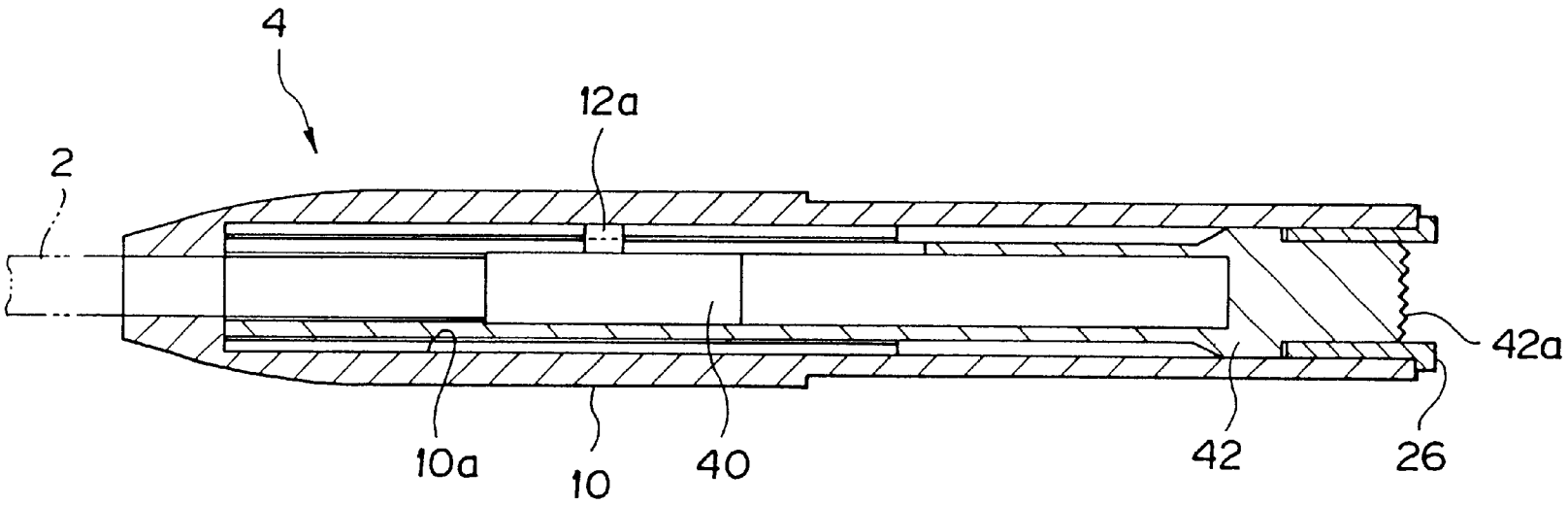
FIG. 13 is a longitudinal sectional view of a cartridge according to the third embodiment.
Figure 14:
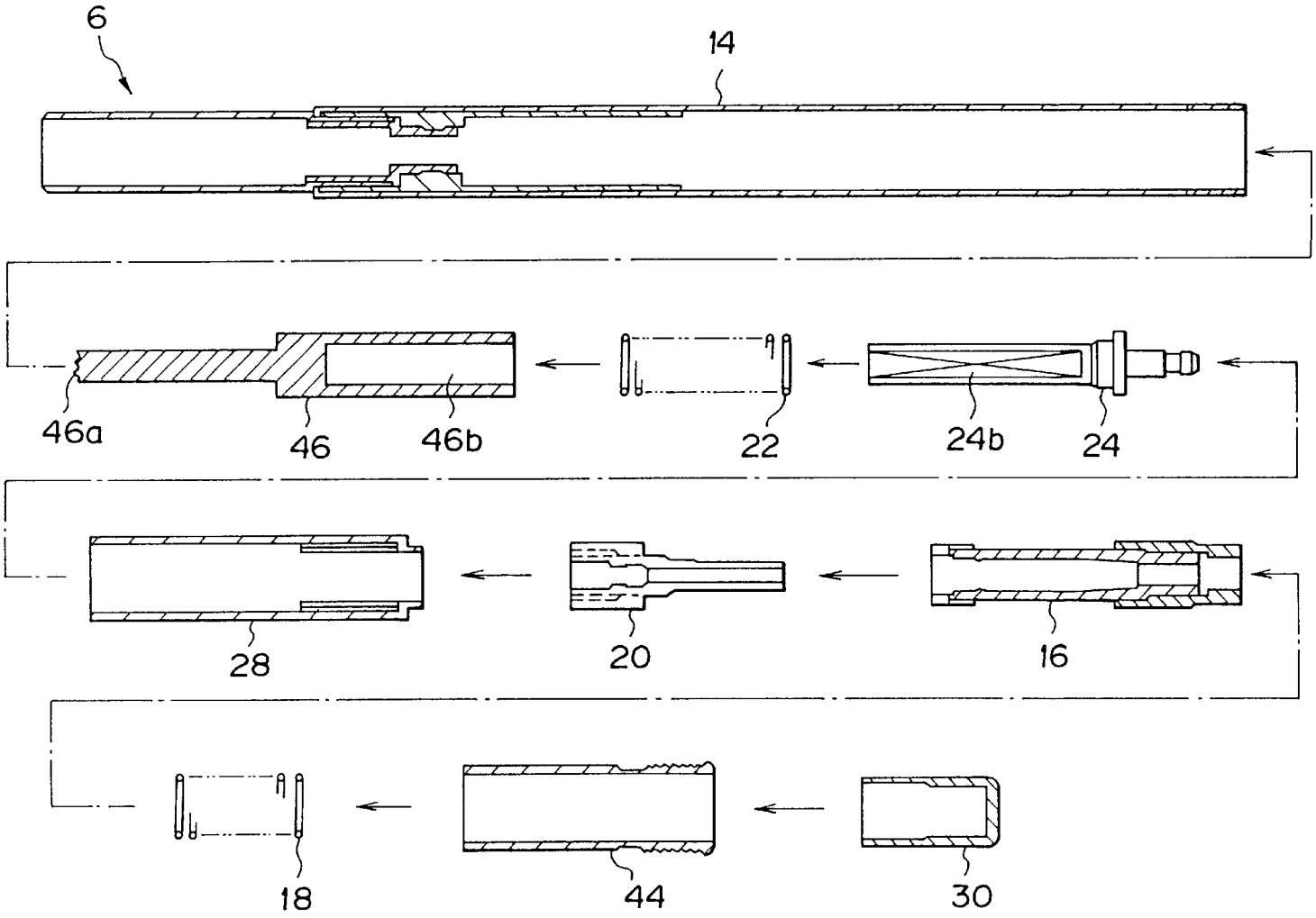
FIG. 14 is an exploded longitudinal sectional view of a container body according to the third embodiment.

The third embodiment will be described. As shown in FIGS. 12 and 13, a stick cosmetic container 8B of the third embodiment is obtained by adding a substantially sawtooth-shaped mesh portion 42*a* to the rear end of a rotary holder 42 of the basic arrangement of the second embodiment. As shown in FIGS. 12 and 14, a container body 6 has a tail end shaft 44 and a push rod 46. The tail end shaft 44 is fitted to the rear end of an outer cylinder 14. The push rod 46 is fitted in a rotation rod 24 from the front side and has a mesh portion 46*a* engaging with the mesh portion 42*a*. The cam type clicking mechanism of the third embodiment functions substantially in the same manner as that of the first and second embodiments, and its description will thus be omitted. The engaging structure of the rotary holder 42 and the push rod 46 is satisfactorily configured if it is capable of transmitting the rotation of the front end of the push rod 46 to the rotary holder 42. An engaging structure other than the substantially sawtooth-shaped mesh portions 42*a* and 46*a*, for example, a structure in which a rod portion having a polygonal cross section (modified profile) and a hollow portion having a cross section of the same shape as this are fitted with each other (e.g., the engaging structure of the rotor 20 and the rotation rod 24 in the rotating direction of the first embodiment or the engaging structure of the holder 12 and the rotation rod 24 in the rotating direction) may also be employed.

A rotor 20 and the rotation rod 24 are fixed by press fitting. When clicking is performed, the rotor 20 rotates the rotation rod 24. A front side portion 24*b* of the rotation rod 24 is formed to have a modified-profile cross section, and is inserted in a hole 46*b* having the same shape as that of the modified-profile cross section formed in the rear end portion of the push rod 46. Thus, the rotation rod 24 is slidable in the forward/backward direction with respect to the push rod 46, while it engages with the push rod 46 in the rotating direction. The push rod 46 is urged forward by a driving spring 22, and its mesh portion 46*a* engages with the mesh portion 42*a* of the rotary holder 42, so that the push rod 46 can transmit a rotational force to the rotary holder 42.

According to this third embodiment, when a clicking cap 30 is clicked, the rotor 20 rotates the rotation rod 24 in accordance with the cam mechanism while it moves forward, in the same manner as in the first and second embodiments. However, since the rotation rod 24 and the rotor 20 are fixed by press fitting, in the third embodiment, the rotation rod 24 moves forward together with the rotor 20 while rotating. The rotational force of the rotation rod 24 is transmitted to the rotary holder 42 through the push rod 46, thereby moving a holder 40 forward in accordance with a screw movement. At this time, although the rotation rod 24 moves forward, it is slidable with respect to the push rod 46. Hence, the forward driving force of the rotation rod 24 is not transmitted to the push rod 46 or the rotary holder 42. Therefore, in this third embodiment as well, since a cosmetic stick 2 always repeats only its forward movement, the unnatural, meaningless movement of the cosmetic stick is eliminated, so that a necessary extension length of the cosmetic stick 2 can be obtained smoothly.

Note that the first to third embodiments described above are the aspects of the preferred embodiments of the present invention, and the technical scope of the present invention is not limited by these embodiments at all.

As has been described above, according to the present invention, the unnatural, meaningless movement of the cosmetic stick upon clicking is eliminated, so that a necessary extension length of the cosmetic stick can be obtained smoothly. In addition, the cosmetic stick can be easily retracted and stored in the cartridge.

What is claimed is:

1. A stick cosmetic container comprising a cartridge for detachably holding a stick cosmetic and a container body on which said cartridge is mounted, wherein said cartridge comprises a substantially cylindrical cartridge body and a holder for detachably holding said cosmetic stick at a front portion thereof to be disposed in said cartridge body and movable forward and backward in accordance with a screw movement when being rotated with respect to said cartridge body, said cartridge body having an inner wall defining a groove and said holder including a screw projection disposed in said groove to move in a forward and rearward direction when said holder rotates relative to said cartridge body;

said container body comprising an outer cylinder, a clicking member, a clicking spring, a rotor, a driving spring, and a rotation rod, wherein said outer cylinder rotatably holds said cartridge body, said clicking member moving forward and backward in said outer cylinder upon being clicked, said clicking spring urging said clicking member backward, said rotor being restrained from rotating when a clicking operation is not performed, while the rotor is rotated when said clicking operation is performed through a predetermined angle by a cam mechanism converting a driving force of said clicking member into a rotational force while moving forward together with said clicking member, said driving spring urging said rotor backward, and said rotation rod being disposed in said outer cylinder to transmit a rotational force of said rotor to said holder and rotating said holder when said rotor is rotated; wherein at least said holder among said holder and said rotor is movable forward/backward with respect to said rotation rod, and said holder rotates, when said clicking operation is performed, through a predetermined angle upon reception of the rotational force from said rotor through said rotation rod to move forward in accordance with the screw movement, and becomes movable forward/backward when said clicking operation is not performed, upon rotation of said cartridge body with respect to said outer cylinder;

said cartridge including a holder lock fitted in a rear end of said cartridge body; and wherein a guide cylinder of which a forward/backward movement is regulated by a front end face of said holder lock is fitted around said holder.

2. A stick cosmetic container according to claim 1 characterized in that said rotation rod has an outer flange constrained in a space defined between a front surface of an inner flange provided to an inner circumferential surface of said outer cylinder and a rear surface of a stopper incorporated in said outer cylinder.

3. A stick cosmetic container according to claim 1 characterized in that a portion of said rotation rod which corresponds to at least a movable range of said rotor has a polygonal section, and a through hole of said rotor also has a polygonal inner shape.

4. A stick cosmetic container according to claim 1 characterized in that a forward movement of said rotation rod is regulated by a tension spring provided between a clicking cap fitted in a rear end of said clicking member and said rotation rod.

5. A stick cosmetic container according to claim 1 characterized in that said guide cylinder comprises a rotary holder that transmits a rotational force of said rotation rod, and a connecting portion having an inner shape corresponding to a shape of a distal end of said rotation rod is formed on a rear end portion of said rotary holder.

6. A stick cosmetic container according to claim 1 characterized in that said guide cylinder comprises a rotary holder that transmits a rotational force of said rotation rod, and a rear end of said rotary holder interlocks with a following member through an engaging structure having a substantially sawtooth-shaped mesh portion.

* * * * *